United States Patent [19]

Perner et al.

[11] 4,239,641

[45] Dec. 16, 1980

[54] USE OF POLYHYDRIC ALCOHOLS, CARBOXYLIC ACIDS, HYDROXY-CARBOXYLIC ACIDS AND/OR THEIR ESTERS WITH POLYHYDRIC ALCOHOLS AS VISCOSITY REGULATORS

[75] Inventors: Johannes Perner, Neustadt; Paul Diessel, Mannheim; Dieter Stoeckigt, Ludwigshafen; Franz Merger, Frankenthal; Juergen Paetsch, Wachenheim, all of Fed. Rep. of Germany

[73] Assignee: BASF Aktiengesellschaft, Fed. Rep. of Germany

[21] Appl. No.: 59,777

[22] Filed: Jul. 23, 1979

[30] Foreign Application Priority Data

Aug. 3, 1978 [DE] Fed. Rep. of Germany ..... 2834073

[51] Int. Cl.[3] ..... C11D 3/065; C11D 3/20; C11D 3/43; C11D 11/02

[52] U.S. Cl. ..... 252/142; 252/89.1; 252/122; 252/132; 252/135; 252/136; 252/139; 252/143; 252/153; 252/162; 252/173; 252/310; 252/363.5; 252/364; 252/539; 252/540; 568/853

[58] Field of Search ..... 252/89.1, 122, 132, 252/135, 136, 139, 142, 143, 153, 158, 162, 170, 173, 310, 363.5, 364, 539, 540; 260/561 R, 561 B; 568/853

[56] References Cited

U.S. PATENT DOCUMENTS

| | | | |
|---|---|---|---|
| 3,415,753 | 12/1968 | Stein | 252/121 |
| 3,554,916 | 1/1971 | Kerfoot | 252/545 |
| 3,692,684 | 9/1972 | Hentschel | 252/174.19 |
| 3,741,913 | 6/1973 | Waag | 252/544 |
| 3,893,955 | 7/1975 | Hewitt | 252/551 |
| 3,915,903 | 10/1975 | Wise | 252/552 |

*Primary Examiner*—Dennis L. Albrecht
*Attorney, Agent, or Firm*—Keil & Witherspoon

[57] ABSTRACT

A method for regulating the viscosity of aqueous detergent and cleanser slurries, in which there are added to the slurries, as viscosity regulators, dihydric, trihydric or tetrahydric aliphatic alcohols, monobasic aliphatic carboxylic acids, hydroxycarboxylic acids, esters of the said alcohols and the said acids or mixtures of these, in which compounds the alcohols, carboxylic acids and hydroxycarboxylic acids, and the individual components of the esters, are of 5 to 9 carbon atoms, of which one is a quaternary atom, the alcohols and hydroxycarboxylic acids carry exclusively primary alcohol groups, and the carboxylic acids and hydroxycarboxylic acids have the carboxyl group bonded to the quaternary carbon atom.

6 Claims, No Drawings

USE OF POLYHYDRIC ALCOHOLS, CARBOXYLIC ACIDS, HYDROXY-CARBOXYLIC ACIDS AND/OR THEIR ESTERS WITH POLYHYDRIC ALCOHOLS AS VISCOSITY REGULATORS

The present invention relates to a novel use of certain polyhydric aliphatic alcohols, carboxylic acids and/or esters of the two categories of compounds as viscosity regulators in aqueous detergent and cleanser slurries.

In preparing detergents by the hot-spray method (tower method), the preparation of the aqueous slurry is a necessary step, which must be carried out with appropriate care. The detergent slurry is an aqueous slurry of inorganic and organic substances, which is prone to unforeseeable fluctuations in viscosity. In preparing detergents and cleansers by the hot-spray method, the uniform character and constancy of properties of the pulverulent end product depend on constancy of the viscosity of the slurry. Fluctuations in viscosity are in general caused by the surfactants contained in the slurry and especially by the hydration characteristics of the phosphates contained in the detergent slurries, and result in inhomogeneous dried products, the inhomogeneity being attributable to the differing water contents of the dried powder particles. To avoid these disadvantages it is firstly necessary to lower the viscosity, because the slurry becomes too viscous as a result of water absorption, and, secondly, to adjust the viscosity to a constant value in order to ensure constant spraying conditions and hence to achieve a uniform bulk density of the finished powder.

Hitherto, conventional hydrotropic agents, eg. cumenesulfonates, toluenesulfonates or xylenesulfonates, in amounts of from 10 to 15% by weight, have been employed to lower the viscosities and maintain them constant.

German Published Application DAS No. 1,617,160 discloses acid phosphoric acid esters as homogenizing agents for slurries; these agents are preferably present in amounts of from 5 to 25% by weight, based on surfactant.

However, the amounts of the hydrotropic agents are such as to produce excessive dilution of the detergent ingredients of the finished products, and hence the detergency of the products is reduced.

The acid phosphoric acid esters, which can be employed in smaller amounts, based on the slurry, are only effective in detergent slurries which contain non-ionic surfactants, with which they evidently interact. Furthermore, there is nothing in German Published Application DAS No. 1,670,160 to indicate that the phosphoric acid esters described there can lower the viscosity of the slurries also described there.

It is an object of the present invention to provide additives which, when used in very small amounts, are capable of lowering the viscosity of the slurries, keeping the viscosity constant and improving the stability of the slurries, ie. which act as viscosity reducers, as viscosity regulators and as stabilizers, without reducing the detergency of the finished products.

We have found that this object is achieved, surprisingly, with polyhydric alcohols, certain carboxylic acids and/or esters of these carboxylic acids with polyhydric alcohols, in which compounds the alcohols, carboxylic acids and hydroxycarboxylic acids, and the individual components of the esters, are of 5 to 9 carbon atoms, of which one is a quaternary atom, the alcohols and hydroxycarboxylic acids carry exclusively primary alcohol groups, and the carboxylic acids and hydroxycarboxylic acids have the carboxyl group bonded to the quaternary carbon atom.

It is true that German Published Application DAS No. 1,670,160 discloses that certain glycols, eg. ethylene glycol and propylene glycol, though not the polyhydric alcohols defined above, can be present in detergent slurries. However, the said publication expressly points out that the action of these compounds differs from that of the phosphoric acid esters; the compounds are stated to be stabilizers for non-ionic surfactants. Per se, these glycols are not presented as acting as viscosity regulators, which function is, in the said publication, exercised by the phosphoric acid esters.

The aliphatic alcohols to be used according to the invention are of 5 to 9 carbon atoms, of which one is quaternary, and contain from 2 to 4 alcoholic hydroxyl groups, which are all primary. Examples of such alcohols are neopentyl glycol, trimethylolpropane, pentaerythritol and their mixtures. Homologs of the said alcohols, carrying primary hydroxyethyl groups instead of methylol groups on the quaternary carbon atom, can also be used.

The carboxylic acids defined above can be employed in place of the alcohols, or as mixtures with these. They also contain from 5 to 9 aliphatic carbon atoms, of which one is quaternary. The carboxylic acids contain one carboxyl group, bonded to the quaternary carbon atom, and may in addition contain primary hydroxyl groups.

Pivalic acid, hydroxypivalic acid and mixtures of these may be mentioned particularly as examples of these carboxylic acids and hydroxycarboxylic acids.

Finally, esters of the alcohols and carboxylic acids defined above may also be used, according to the invention, either alone or as components of a mixture, and amongst these the esters of the above specifically mentioned individual components are preferred. Esters of neopentyl glycol and hydroxypiraic acid, preferably neopentyl glycol monohydroxypivalate, are of particular interest.

By themselves, the compounds (alcohols, acids and esters) act as agents for lowering extremely high viscosities. For some purposes, for example in order to obtain, by spray drying, washing powders having a high content of detergent and a low content of water of hydration, medium viscosity ranges are required, ie. substances having an even better regulating action are needed.

According to the invention, this is achieved by using a mixture of the above alcohols with the carboxylic acids and/or the esters.

Up to 60% by weight, based on the resulting mixtures, of the carboxylic acids and/or esters can be added to the alcohols, and this gives a combination which produces medium viscosities and exerts a particularly advantageous regulating function. Using these mixtures, it is possible to produce slurries which, though having a relatively low water content, are still very easy to pump; these slurries, on spray-drying, give washing powders having the desired high content of detergent and low content of water of hydration. Mixtures of alcohols and acids are particularly effective if the proportion of acid is from 10 to 60% by weight, based on the mixture; if an ester is also present, it is advantageous to use from about 40 to 50% by weight of ester and only from 10 to 20% by weight of acid.

Particularly advantageous mixtures are combinations of a polyhydric alcohol, a hydroxycarboxylic acid and a hydroxycarboxylic acid ester, and amongst these a mixture of neopentyl glycol, hydroxypivalic acid and neopentyl glycol hydroxypivalic acid ester is preferred.

This mixture is particularly easily obtainable industrially.

The alcohols or mixtures of the alcohols with acids and/or esters are added to the slurries in amounts of from 1 to 6% by weight, preferably from 3 to 6% by weight, based on solids. Larger amounts are equally effective, but do not offer any additional advantages.

The Examples which follow illustrate the invention, for various detergent formulations, as regards the viscosity characteristics with and without addition of regulator.

EXAMPLES

The following experiments were carried out:

The regulators tested were:

(a) a mixture of 40% by weight of neopentyl glycol, 10% by weight of hydroxypivalic acid and 50% by weight of neopentyl glycol hydroxypivalic acid ester
(b) neopentyl glycol
(c) neopentyl glycol hydroxypivalic acid ester
(d) pivalic acid
(e) hydroxypivalic acid
(f) Na cumenesulfonate.

5 detergent slurries of different composition were tested:

Test conditions:

Slurry:

70% of powder and 60% of powder
30% of water
40% of water

Slurry temperature: 70° C.

The viscosity measurements (mPa.s) were carried out in a Brookfield viscometer, after 15, 30 and 60 minutes.

The percentages shown in the individual Examples relate to the total weight of the non-aqueous constituents.

EXAMPLE 1

38% of Na sulfate
40% of pentasodium triphosphate
5% of Na metasilicate×5 $H_2O$
3% of soap powder (based on tallow fatty acid/-coconut fatty acid)
1% of carboxymethylcellulose
10% of 50% strength Na dodecylbenzenesulfonate
3% of $C_{13/15}$-oxo-alcohol×12 ethylene oxide.

The mixture was formulated as an aqueous slurry containing 70% by weight of non-aqueous constituents.

The Table which follows shows the results:

| Time | Viscosity (mPa.s) 15 min | 30 min | 60 min |
|---|---|---|---|
| Slurry without regulator | 100,000 | 100,000 | 100,000 |
| + 5% of regulator | | | |
| (a) | 13,000 | 7,500 | 6,200 |
| (b) | 700 | 7,500 | 1,000 |
| (c) | 11,000 | 18,000 | 20,000 |
| (d) | 10,000 | 8,000 | 14,000 |
| (e) | 13,000 | 15,000 | 1,500 |

-continued

| Time | Viscosity (mPa.s) 15 min | 30 min | 60 min |
|---|---|---|---|
| (f) | 57,000 | 40,000 | 38,000 |

In the Examples which follow, the procedures used were similar to those in Example 1.

EXAMPLE 2

34% of Na sulfate
40% of pentasodium triphosphate
10% of sodium metasilicate×5 $H_2O$
1% of carboxymethylcellulose
7% of 85% strength Na dodecylbenzenesulfonate
5% of $C_{13/15}$-oxo-alcohol×8 ethylene oxide
3% of soap (based on tallow fatty acid/coconut fatty acid)

Viscosity measurements (mPa.s)

Slurry: 70% of active substance

| Time | 15 min | 30 min | 60 min |
|---|---|---|---|
| Slurry without regulator | 100,000 | 100,000 | 100,000 |
| + 3% of regulator | | | |
| (a) | 50,000 | 25,000 | 2,000 |
| (b) | 5,000 | 5,000 | 4,200 |
| (d) | 11,200 | 11,200 | 11,200 |
| (e) | 3,200 | 2,900 | 2,800 |
| + 5% of regulator | | | |
| (a) | 24,500 | 16,000 | 11,500 |
| (b) | 1,000 | 3,000 | 2,500 |
| (d) | 8,000 | 8,000 | 8,000 |
| (e) | 6,000 | 6,400 | 6,400 |

Slurry: 60% of active substance

| Time | 15 min | 30 min | 60 min |
|---|---|---|---|
| Slurry without regulator | 100,000 | 100,000 | 100,000 |
| + 5% of regulator | | | |
| (a) | 13,000 | 7,500 | 6,200 |
| (b) | 700 | 7,500 | 1,000 |
| (c) | 11,000 | 18,000 | 20,000 |
| (d) | 10,000 | 8,000 | 14,000 |
| (e) | 13,000 | 15,000 | 1,500 |
| (f) | 57,000 | 40,000 | 38,000 |

EXAMPLE 3

36% of Na sulfate
40% of pentasodium triphosphate
5% of sodium metasilicate×5 $H_2O$
1% of carboxymethylcellulose
3% of soap (based on tallow fatty acid/coconut fatty acid)
10% of 50% strength Na dodecylbenzenesulfonate
5% of tallow fatty alcohol×25 ethylene oxide Viscosity measurements (mPa.s)

Slurry: 70% of active substance

| Time | 15 min | 30 min | 60 min |
|---|---|---|---|
| Slurry without regulator | 100,000 | 100,000 | 100,000 |
| + 5% of regulator | | | |
| (a) | 34,000 | 23,000 | 14,000 |
| (b) | 6,000 | 5,500 | 5,000 |
| (d) | 24,000 | 24,000 | 23,000 |
| (f) | 70,000 | 70,000 | 65,000 |

EXAMPLE 4

34% of Na sulfate
20% of pentasodium triphosphate
20% of zeolite A (Na Al silicate)
10% of Na metasilicate × 5 $H_2O$
1% of carboxymethylcellulose
3% of soap (based on tallow fatty acid/coconut fatty acid)
7% of 85% strength Na dodecylbenzenesulfonate
5% of $C_{13/15}$-oxo-alcohol × 8 ethylene oxide Viscosity measurements (mPa.s)

Slurry: 70% of active substance

| Time | 15 min | 30 min | 60 min |
|---|---|---|---|
| Slurry without regulator | 100,000 | 100,000 | 100,000 |
| + 3% of regulator | | | |
| (a) | 13,000 | 10,000 | 8,000 |
| (b) | 5,000 | 10,000 | 5,000 |
| (d) | 7,000 | 8,000 | 8,000 |
| (e) | 6,500 | 6,500 | 6,500 |

Slurry: 60% of active substance

| | | | |
|---|---|---|---|
| Slurry without regulator | 13,000 | 13,000 | 13,000 |
| + 3% of regulator | | | |
| (a) | 800 | 800 | 700 |
| (b) | 1,000 | 900 | 800 |
| (d) | 8,000 | 7,000 | 7,000 |
| (e) | 10,000 | 9,000 | 9,000 |

EXAMPLE 5

34% of Na sulfate
15% of pentasodium triphosphate
15% of zeolite A (Na Al silicate)
10% of tetrasodium nitrilotriacetate
1% of carboxymethylcellulose
10% of Na metasilicate × 5 $H_2O$
3% of soap (based on tallow fatty acid/coconut fatty acid)
7% of 85% strength Na dodecylbenzenesulfonate
5% of $C_{13/15}$-oxo-alcohol × 10 ethylene oxide Viscosity measurements (mPa.s)

Slurry: 50% of active substance

| Time | 15 min | 30 min | 60 min |
|---|---|---|---|
| Slurry without regulator | 20,000 | 16,000 | 11,000 |
| + 3% of regulator | | | |
| (a) | 4,600 | 3,100 | 2,500 |
| (b) | 1,500 | 1,200 | 1,200 |
| (d) | 2,200 | 2,100 | 2,100 |
| (e) | 4,000 | 5,600 | 5,000 |
| + 5% of regulator | | | |
| (a) | 700 | 1,000 | 1,000 |
| (b) | 500 | 500 | 550 |
| (d) | 1,000 | 1,200 | 1,200 |
| (e) | 4,000 | 4,500 | 4,500 |

We claim:

1. A method for regulating the viscosity of aqueous slurries of detergents and cleansers, wherein there are added to the slurries, as viscosity regulators, dihydric, trihydric or tetrahydric aliphatic alcohols, monobasic aliphatic carboxylic acids, hydroxycarboxylic acids, esters of the said alcohols and the said acids or mixtures of these, in which compounds the alcohols, carboxylic acids and hydroxycarboxylic acids, and the individual components of the esters, are of 5 to 9 carbon atoms, of which one is a quaternary atom, the alcohols and hydroxycarboxylic acids carry exclusively primary alcohol groups, and the carboxylic acids and hydroxycarboxylic acids have the carboxyl group bonded to the quaternary carbon atom, the amount of said regulators being at least 1% by weight based on the solids content of the slurries, said regulators acting to reduce the viscosity of the slurries and to stabilize the slurries against fluctuations in viscosity.

2. The method of claim 1, wherein trimethylolpropane, neopentyl glycol, pentaerythritol or a mixture of these is employed as the polyhydric alcohol.

3. The method of claim 1 or 2, wherein pivalic acid, hydroxypivalic acid or a mixture of these is employed as the hydroxycarboxylic acid.

4. The method of claim 1, wherein neopentyl glycol hydroxypivalic acid ester is employed.

5. The method of claim 1, wherein from 1 to 6% by weight of regulators are added to the slurries, the percentage being based on solids.

6. The method of claim 5, wherein from 3 to 6% by weight of regulators are added to the slurries.

* * * * *